United States Patent [19]

Doskocil

[11] Patent Number: 4,958,457

[45] Date of Patent: Sep. 25, 1990

[54] TRENCH DIGGING OR ROOT CUTTING DEVICE

[76] Inventor: David Doskocil, 1227 Fulbright Avenue, Redlands, Calif. 92373

[21] Appl. No.: 318,584

[22] Filed: Mar. 3, 1989

[51] Int. Cl.[5] ..... E02F 5/08

[52] U.S. Cl. ..... 37/94; 37/189; 172/43; 172/112; 172/120

[58] Field of Search ..... 37/80 A, 91, 94, 189, 37/DIG. 16; 172/43, 112, 120

[56] References Cited

U.S. PATENT DOCUMENTS

| | | | |
|---|---|---|---|
| 677,000 | 6/1901 | Stephens | 37/94 |
| 1,538,565 | 5/1925 | Loken | 37/94 |
| 1,858,360 | 5/1932 | Cruse | 37/94 |
| 2,679,703 | 6/1954 | Borel | 37/92 |
| 2,907,163 | 6/1959 | Mollahan | 56/25.4 |
| 2,912,022 | 11/1959 | Ver Ploeg et al. | 144/2 |
| 2,979,837 | 4/1961 | Hunter | 37/94 |
| 3,041,750 | 7/1962 | Garnand | 37/92 |
| 3,308,860 | 3/1967 | DeShano | 144/2 |
| 3,319,365 | 5/1967 | Perry et al. | 37/94 |
| 3,336,958 | 8/1967 | Carlton | 144/2 |
| 3,577,664 | 5/1971 | Sing et al. | 37/192 |
| 3,625,267 | 12/1971 | Welborn | 144/2 N |
| 3,732,905 | 5/1973 | Pickel | 144/2 Z |
| 3,767,262 | 10/1973 | Pentith | 37/189 |
| 3,783,914 | 1/1974 | Daugherty et al. | 144/2 N |
| 4,271,879 | 6/1981 | Shivers, Jr. et al. | 144/2 N |
| 4,503,630 | 3/1985 | Riley | 37/189 X |
| 4,678,042 | 7/1987 | Barton et al. | 37/94 X |
| 4,703,786 | 11/1987 | Doskocil | 144/2 N |

FOREIGN PATENT DOCUMENTS

| | | | |
|---|---|---|---|
| 308928 | 9/1932 | Italy | 37/94 |
| 556966 | 6/1957 | Italy . | |

OTHER PUBLICATIONS

Brochure for T116 Bobcat Trencher, Melroe Co. (4 pages).

Brochure for T108 Bobcat Trencher, Melroe Co. (4 pages).

Brochure for TL100 Trencher, J. I. Case Company (2 pages).

Brochure for E-Z Trencher, E-Z Trench Mfg., (one page).

Brochure for Trench Master, Brown Manufacturing Corporation (one page).

*Primary Examiner*—Randolph A. Reese
*Assistant Examiner*—Arlen L. Olsen
*Attorney, Agent, or Firm*—Lyon & Lyon

[57] ABSTRACT

An apparatus for ditch digging or root pruning having a main frame on which a motor drive mechanism and a cutting wheel are supported. A secondary frame portion or undercarriage is pivotally attached to the main frame. The cutting wheel is preferably mounted on a transverse shaft parallel to the wheel axis, the cutting wheel rotating in a substantially vertical plane located outside the apparatus wheels. An actuation device is provided to pivot the frame portions thereby raising or lowering the cutting wheel.

17 Claims, 5 Drawing Sheets

FIG. 7.
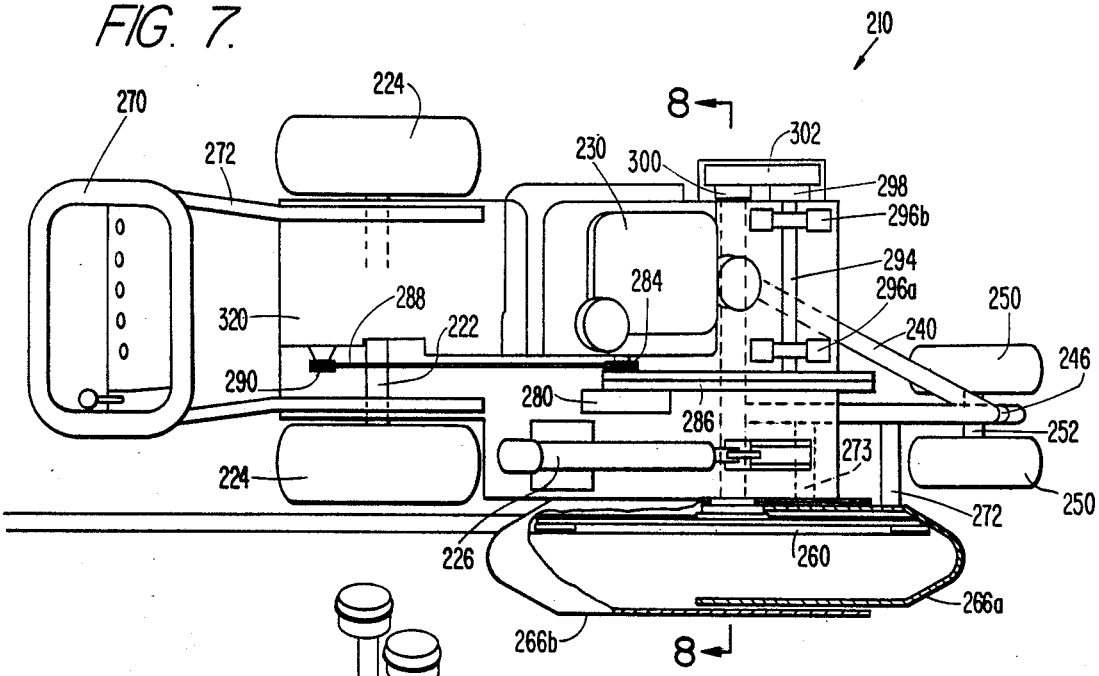
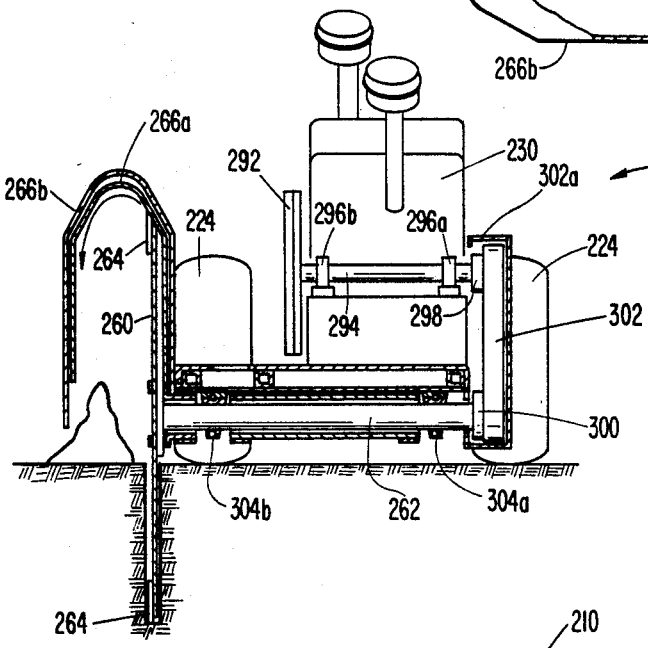
FIG. 8.
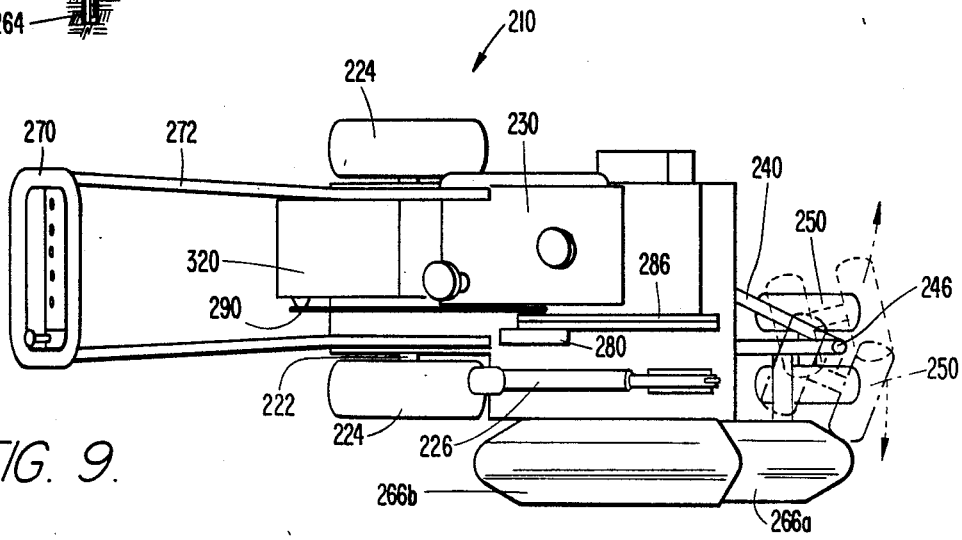
FIG. 9.

TRENCH DIGGING OR ROOT CUTTING DEVICE

BACKGROUND OF THE INVENTION

The field of the present invention relates to ditch digging machines or the like which are designed to form or cut a trench in the ground. One such ditch digging machine is known as the chain digger in which a large chain which is similar to a chain saw configuration rotates into the ground to perform the desired digging action.

Another such machine has a rotating cutting wheel having teeth around its circumference, the cutting wheel rotating and cutting its way into the ground. The cutting wheel digging machines have an operating means such that the cutting wheel may be lowered into the ground. Such a machine is disclosed in U.S. Pat. No. 4,503,630. Typically, such a machine has its cutting wheel mounted on a main frame, the entire frame being raised or lowered above the wheels in order to raise or lower the cutting blade into the ground. In order to raise the cutting wheel, the entire motor and the majority of the machine's weight must be lifted in order to lift the cutting blade. To assist in the lifting motion, springs may be provided to offset some of the weight during lifting. Since the cutting blade must be raised above the ground during transport, the machine must be placed in its raised position with the motor in its highest condition which can decrease maneuverability and result in imbalance as well as increased overall bulk of the machine. The cutting blade is located inside the wheelbase and within the wheel axis so the wheels straddle the trench being dug.

SUMMARY OF THE INVENTION

The present invention is directed to a new ditch digging or root cutting machine. The machine has a wheel axis which may include a main axle having a wheel at either end, the distance between the wheels establishing a wheel width or axis. The wheels support a main frame on which a motor drive mechanism and a cutting wheel are supported. One end of a secondary frame portion or undercarriage is pivotally attached to the main frame. The secondary frame portion has a steerable wheel on its end opposite the main frame. The cutting wheel is preferably mounted on a transverse shaft parallel to the wheel axis, the cutting wheel rotating in a substantially vertical plane located outside the wheel width. An actuation device is provided to pivot the frame portions thereby raising or lowering the cutting wheel.

BRIEF DESCRIPTION OF THE DRAWINGS

FIG. 7 is a top plan view of the cutting machine of FIG. 6 taken along the line 7—7;

FIG. 8 is a diagrammatic cross-sectional view of the cutting machine of FIG. 7 taken along the line 8—8;

FIG. 9 is a top plan view of the cutting machine of FIG. 5 taken along the line 9—9;

DETAILED DESCRIPTION OF PREFERRED EMBODIMENTS

Figure 1:
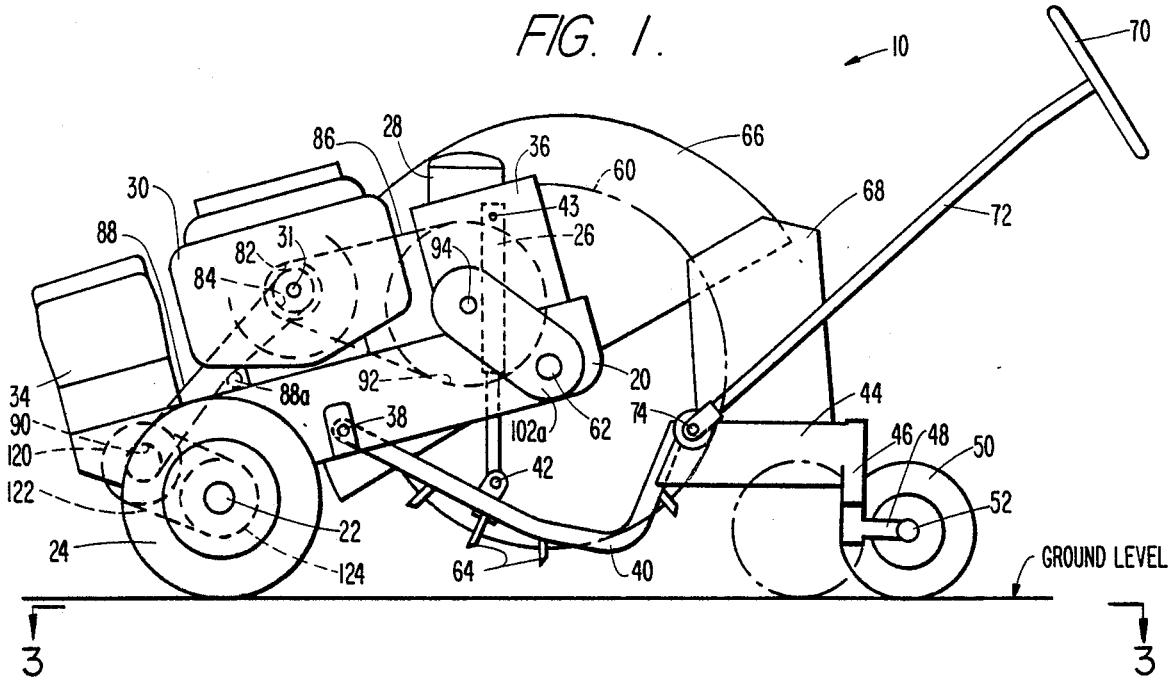
FIG. 1 is a diagrammatic side elevation view of a machine according to the present invention having a cutting wheel in the raised position.

The preferred embodiments will now be described with reference to the figures. For ease of description, a numeral representing an element in one figure will represent the same element in any other figure.

Referring to FIGS. 1, 2, 2A, and 2B, a root cutting or pruning machine 10 is illustrated with a cutting wheel 60 mounted on a main frame or front frame portion 20, the cutting wheel 60 being rotatably mounted on a cutting wheel shaft 62. The root pruning machine 10 also has a rear frame portion or undercarriage 40 which is pivotally connected to the main frame 20 at frame pivot 38. Most of the components of the pruning machine 10, including the cutting wheel 60, the motor or engine 30, and the drive mechanism (described later) are all mounted on and supported by primarily the main frame portion 20.

Figure 2:
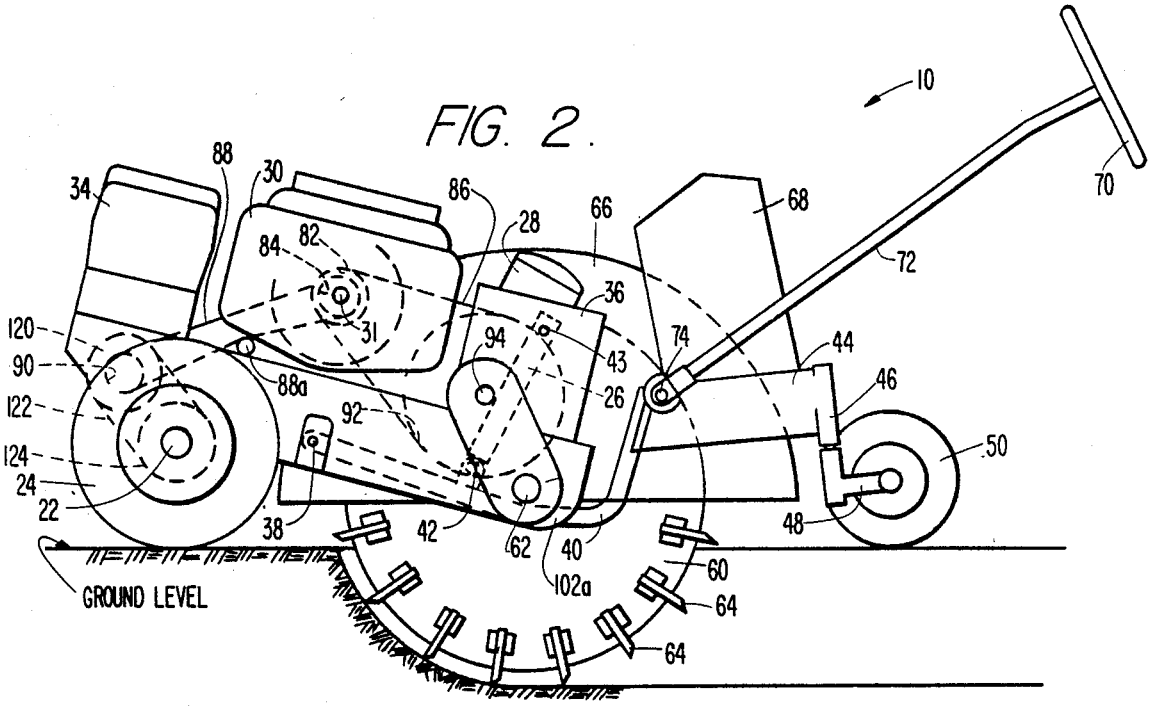
FIG. 2 is a diagrammatic side view of the machine as in FIG. 1 with the cutting wheel in a lowered position.
Figure 2A:
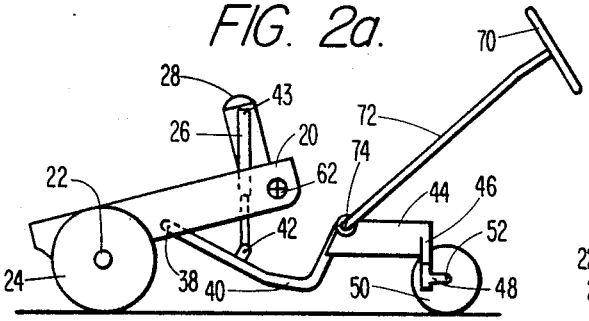
FIGS. 2A and 2B diagrammatically illustrate the actuation configuration in isolation with the frame and undercarriage, FIG. 2A illustrating the device in the raised, travelling condition and FIG. 2B illustrating the device in the lowered, digging position.
Figure 2B:
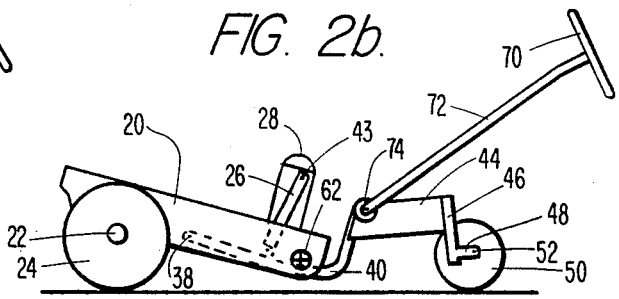

As described above, the cutting mechanism of a typical trench digging machine (such as cutting wheel 60) must be capable both of being raised up out of the ground during transport and being lowered into the ground during the cutting or digging operation. The raising or lowering of the cutting wheel 60 is accomplished by the pivoting action between the main frame 20 and the undercarriage 40. As best viewed in the schematics of FIGS. 2A and 2B, an actuator 26 is provided between the undercarriage 40 and the main frame 20 such that when the actuator motor 28 is activated, the actuator 26 selectively expands or contracts thereby pivoting the main frame 20 and the undercarriage 40 about the frame pivot 38. Therefore, when the actuator 26 is in the extended position, as depicted in FIG. 1 or FIG. 2A, the cutting wheel 60 is in the raised condition clear of the ground. When the actuator 26 is in the retracted position, such as depicted in FIG. 2 or FIG. 2B, the cutting wheel 60 is in the lowered or trenching position below the ground level.

A front axle 22 attached to a front portion of the main frame 20 has a front wheel 24 on either side thereof. Since the majority of the components of the trenching machine 10 are on the main frame 20, the majority of the load is placed onto the front axle 22. A rear wheel support 44 is attached to the rear portion of the undercarriage 40. A king pin 46 attached to the rear wheel support 44 is pivotally attached to a rear wheel arm 48 which in turn supports a rear wheel axle 52 which is rotatably connected to the steerable rear wheel 50.

The root pruning machine 10 is steered from the rear by grasping the steering handle 70 and applying force to the steering handle 70. By utilizing leverage along the steering handle column 50 attached between the steering handle 70 and the rear support 44, the rear wheel 72 can be pivoted about the king pin 46 thereby permitting steering of the root pruning machine 10. The steering handle column 72 is adjustable by its pivotal connection to the rear wheel support 44 at pivot point 74 to allow for height adjustment of the steering handle 70.

The steering handle 70 may include control levers or the like for operating and controlling all the mechanisms of the machine 10. From the position at the steering handle 70, the operator may therefore: activate the actuation motor 28 to raise or lower the cutting wheel 60, adjust engine speed, adjust travel speed, or start and stop the engine.

As previously stated, most of the main components are mounted on the main frame 20 including the engine 30 which is supplied with fuel from gas tank 34. Towards the rear of the main frame 20, a battery 36 is mounted which may be provided with a charging device operatively connected to the engine 30, the battery 36 supplying power to the actuator motor 28. The battery 36 may also provide the power for a starter of the engine 30.

The actuator 26 is the preferred means for pivoting the main frame 20 relative to the undercarriage 40. The actuator 26 is preferably powered by an electric actuator motor 28 which allows for infinite height adjustment of the cutting wheel 60. Other pivoting means such as a lever mechanism may be employed in place of the actuator 26 by one skilled in the art.

Locating most of the machine weight over the front axle 22 results in a stable configuration. Such a weight distribution also facilitates steering by reducing the weight supported by the steerable rear wheel 50. The pivoting action and weight distribution also minimizes the amount that machine components need to be raised when raising the cutting wheel 60 thereby allowing the machine 10 to maintain a stable, low center of gravity. Minimizing the need to raise the machine components also reduces power requirements of the actuator motor 28. Moreover, the shaft 62 of the cutting wheel 60 is parallel to the frame pivot 38 and rearwardly offset therefrom maximizing actuation distance of the cutting wheel 60 during the pivoting motion.

When the cutting wheel 60 is lowered (from the raised position as in FIG. 1 to the lowered position as in FIG. 2) some weight is transferred from the front wheels 24 to the rear wheels 50 thereby applying more weight to the cutting wheel 60 for digging.

Also connected to the main frame 20 is a cutting wheel guard 66 having a hemispherical shape which encloses a top half of the cutting wheel 60. The cutting wheel guard 66 is raised and lowered with the cutting wheel 60. In order to provide complete protection and coverage of the cutting wheel 60, the cutting wheel guard 66 cooperates with a curved vertical shield 68, the vertical shield 68 being attached to the rear frame portion 40 such as to the rear of wheel support 44. Therefore, when the cutting wheel 60 is in the raised or partially raised position, the vertical shield surrounds the rear portion of the cutting wheel 60 which would otherwise be exposed below the cutting wheel guard 66.

The drive mechanisms will now be described with respect to FIGS. 1, 2, 3, 4, and 4A. FIG. 4A is a schematic perspective view of the drive mechanisms. The engine 30 rotates the engine shaft 31 t o provide motive force for both the cutting wheel 60 and the front wheel 24. A clutch 80, operatively connected to the engine shaft 31, cooperates therewith to selectively engage a front wheel drive pulley 84 and a cutting wheel pulley 82. Preferably of centrifugal design, the clutch 80 may control the transfer of power so that the cutting wheel 60 will not be rotated unless the engine is above a given speed level.

A drive belt 86 connects the cutting wheel pulley 82 to another pulley 92, which is of larger diameter to provide desired speed reduction. The pulley 92 is mounted on a jack shaft 94, the jack shaft 94 being supported on the main frame 20 by bearings 96*a* and 96*b*. A gear 98 is connected to the end of the jack shaft 94 opposite to the pulley 92. Chain drive 102 engages the gear 98 with a drive gear 100 which is on one end of the cutting wheel shaft 62. The cutting wheel shaft 62 is rotatably mounted on the main frame 20 by bearings 104*a* and 104*b*. The cutting wheel 60 is supported and rotated by the cutting wheel shaft 62, the cutting wheel 60 being securely mounted to the end of the cutting wheel shaft 62. The length of the cutting wheel shaft 62 is desirably long extending much of the width of the main frame 20. The greater the distance between the bearings 104*a* and 104*b*, the firmer the support of the cutting wheel 60.

The root pruning machine 10 is power driven by driving the front wheels 24 and 24*a* off of the engine 30. As previously described, the drive belt 88 drives the pulley 90 which rotates a drive shaft 91. The drive shaft 91 powers a hydrostatic drive mechanism 120 off which a drive belt 122 provides a direct drive to a transmission axle 124, thereby rotating the front wheels 24 and 24*a*. An adjustable idler pulley 88*a* is provided along the drive belt 88 to supply tension to the drive belt 88. The hydrostatic drive mechanism 120 allows for infinite variation of travel speed to permit the operator to select a desired rate of cut.

Figure 4:
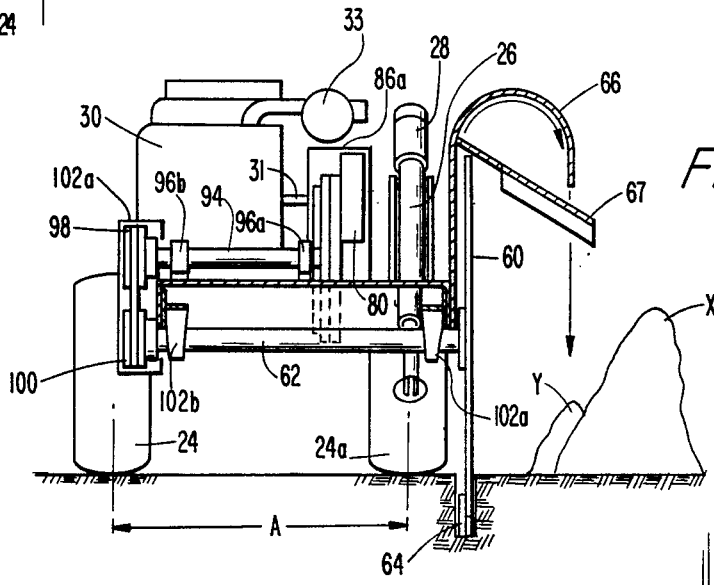
FIG. 4 is a cross-sectional view of the machine of FIG. 3 taken along the line 4—4.

Protective covers may be provided over the rotating components. For example, as shown in FIGS. 1 and 2, a chain guard 102*a* is positioned around the drive chain 102. Similarly, FIG. 4 illustrates a belt guard 86*a* which covers both the clutch 80 as well as drive belts 86 and 88. These guards also isolate the various drive mechanisms from dirt and debris inevitably encountered during digging operations. The orientation of the jack shaft 94, being offset from the cutting wheel 62, enhances this protection and facilitates coverage of the belt drive mechanisms as dirt and debris traveling along the cutting wheel shaft 62 has no entryway toward the drive belts 86 or 88. The drive chain 102 is also protected from debris thrown by the cutting wheel 60 due to its location on the opposite side of the cutting wheel shaft 62 from the cutting wheel 60.

Figure 3:
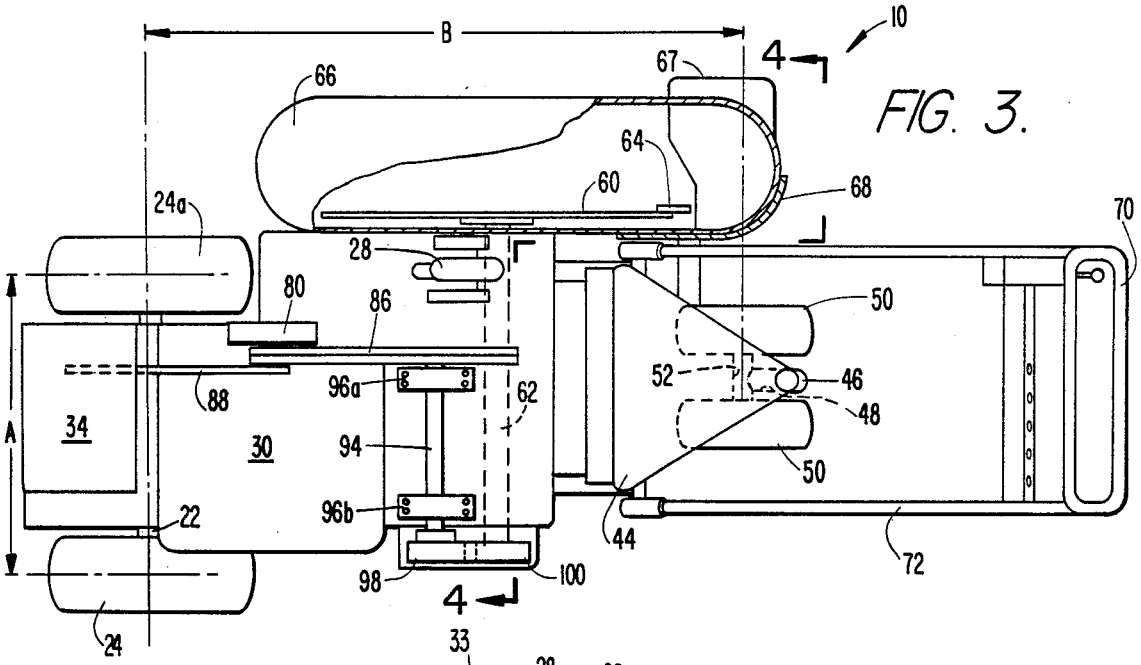
FIG. 3 is a diagrammatic top plan view of the machine of FIG. 2 taken along the line 3—3.
Figure 4A:
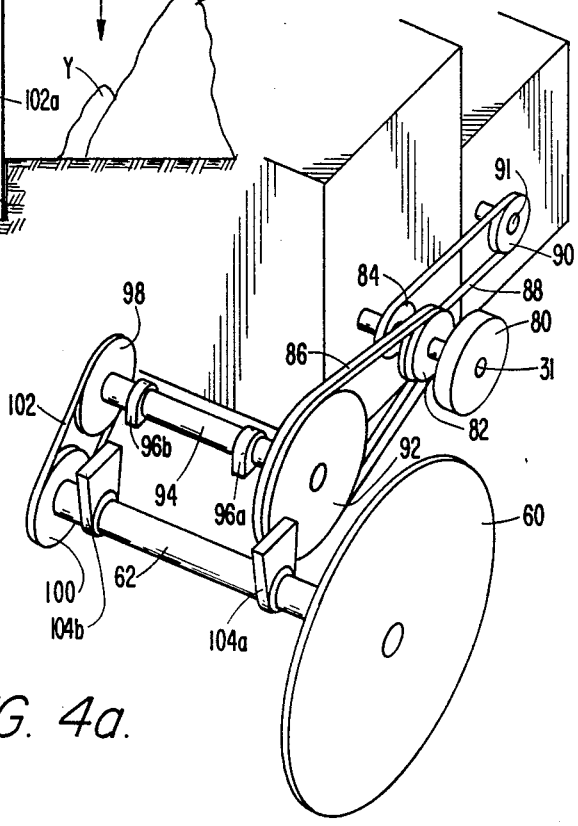
FIG. 4A is a diagrammatic perspective view of the cutting wheel drive mechanism.
Figure 5:
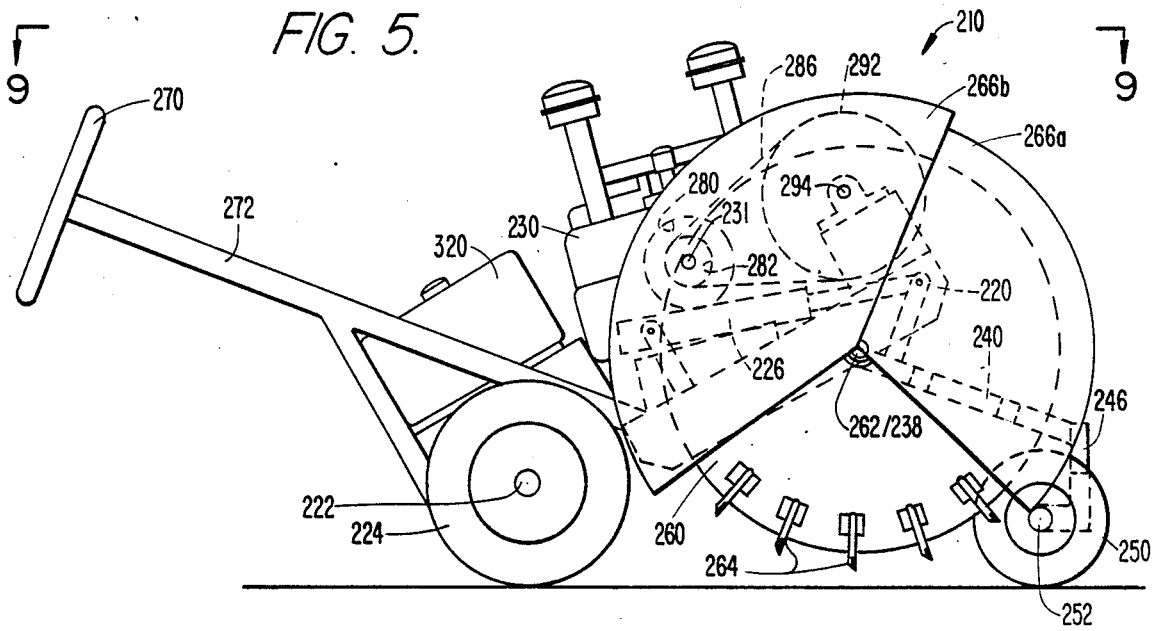
FIG. 5 is an alternate machine shown with the cutting wheel in the raised position.
Figure 6:
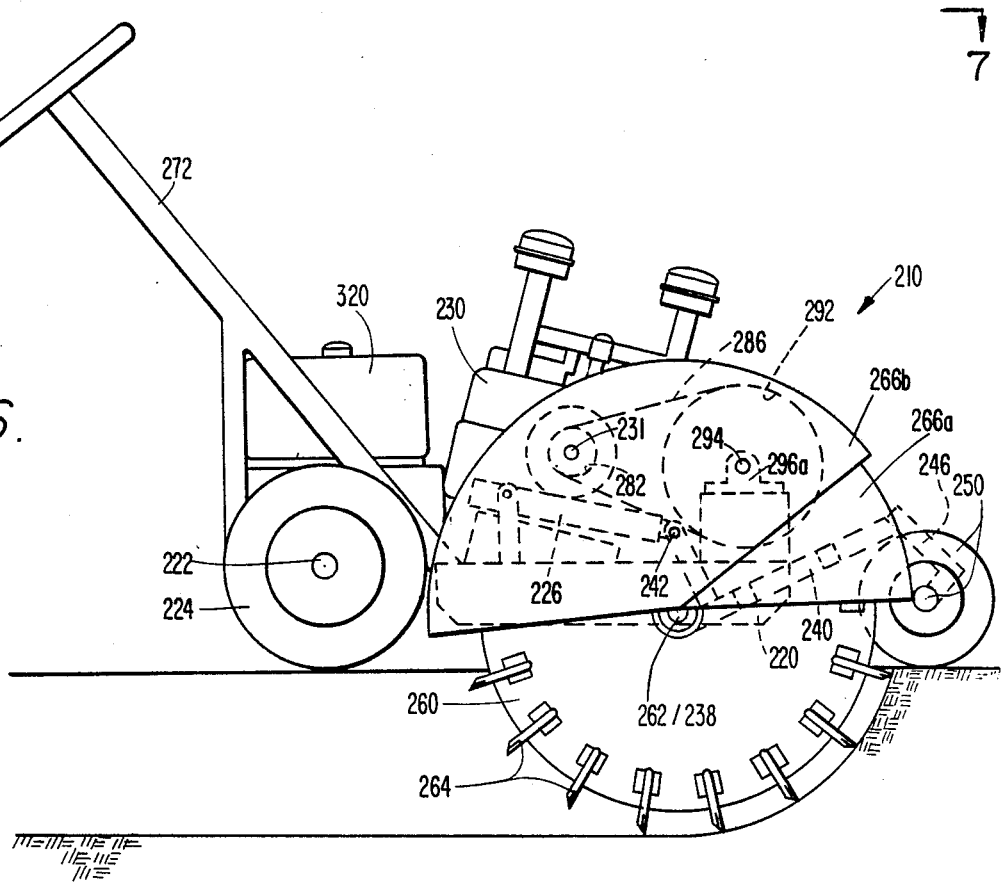
FIG. 6 is a side elevation view of the alternate cutting machine of FIG. 5 showing the cutting wheel in the lowered position.

As viewed in FIGS. 3 and 4, the pruning machine 10 is defined to have a wheel base "B" and a wheel width or axis "A" which is the distance between the front wheels 24 and 24*a*. The wheel width determines machine stability relative to a tipping motion and also affects the steerability of the unit. The greater the wheel width "A" the more stable the machine 10 but the more difficult to steer.

The cutting wheel 60 is preferably positioned within the wheel base "B" resulting in a stable machine configuration. The configuration also facilitates support for the cutting wheel guard 66.

As viewed in FIG. 4, the cutting wheel 60 is placed outside the wheel width "A". As the cutting wheel 60 rotates upward (in a clockwise direction as viewed in FIG. 2) dirt and debris is thrown upward into the cutting wheel guard 66 which is curved to direct the dirt outward away from the trench being dug and away from the pruning machine 10. Momentum of the dirt being thrown upward by the cutting wheel 60 into the cutting wheel guard 66 will cause the dirt to circle rearward and outward along the curved inner surface of the cutting wheel guard 66. The majority of the dirt will have sufficient velocity to reach the rearmost portion of the cutting wheel guard 66 where the dirt will encounter a diverter 67 which in turn will direct the dirt further outward and away from the pruning machine 10. As viewed in FIG. 4, dirt which has insufficient velocity to reach the rear of the cutting wheel guard 66 will fall downward and form a pile "Y", but the majority of the dirt will reach the rear of the cutting wheel guard 66 and be diverted by the diverter 67 forming an outer pile "X".

By locating the cutting wheel 60 outside the wheel width "A", dirt and debris may be directed outward and away from both the trench being dug and the wheels. This is particularly useful when a wide trench is desired to be dug.

By trenching in a backwards direction (in a direction to the right as viewed in FIG. 2) dirt may be directed back into the trench being cut. Such a variation may be desireable, for example, when only a root pruning operation is being performed and it is desireable to refill the trench. The device 10 may be equipped with a flexible flap (not shown) attached to the bottom of the cutting wheel guard 66 nearest the front wheels 24.

One application for the device 10 is for root cutting or pruning. A problem exists in many municipalities that trees growing along the side of sidewalks send their roots under the sidewalks causing the sidewalks to buckle and crack. The root cutting machine 10 provides a effective method for cutting these roots immediately adjacent the sidewalk encouraging the trees to send the roots deeper into the ground without stressing the concrete sidewalk. As such, the root cutting device 10 can be operated along the sidewalk with the cutting wheel 60 being offset outside the wheel width cutting the surface roots down to a desired depth and digging a trench of the desired width. The cutting machine wheels 24 and 50 remain on the sidewalk during operation thereby avoiding having to roll along uneven ground which would produce an uneven trench. By diverting dirt and debris to the side, a clean, open trench is prepared into which a root barrier may be inserted and then allowing the trench to be conveniently refilled.

The pivoting action of the main frame 20 relative to the rear frame portion 40 not only raises and lowers cutting wheel 60 when the cutting wheel 60 is in the lowered position, the wheel base of the machine 10 increases slightly. At the same time the king pin 46 which supports the steerable rear wheel 50 is inclined slightly from the vertical as viewed in FIG. 2. Since cutting or digging operation is typically performed in a straight line, this inclined nature of the king pin 46 when the cutting wheel 60 is in the digging position helps to provide stability to the machine during travel.

An alternative embodiment is illustrated in FIGS. 5–10. The alternative trenching machine 210 also has a main frame 220 which is pivotally attached to a secondary frame portion 240 at pivot point 238. In contrast to the earlier embodiment, the alternative trenching machine 210 has a steerable wheel 250 at the front of the machine 210. The main axle 222 supports wheels 224 in the rear of the machine 210. An actuator 226 is provided to selectively pivot the main frame 220 and the secondary frame portion 240 to raise and lower the cutting wheel 260, the wheel base of the machine 210 varying substantially during actuation. The main frame is substantially supported on a rear axle 222, the rear axle 222 having rear wheel 224, a motor 230 and the drive mechanisms are also supported on the main frame 220. The machine 210 is steered from the rear by applying force to the steering wheel 270 through leverage along the steering wheel column 272 attached to the main frame 240. The front wheels. 250, attached on opposite ends of shaft 252, pivot about the king pin 246 to provide steerability to the machine 210. The secondary frame 240 on which the king pin 246 is mounted, offsets the wheels 250 toward the cutting wheel 260 since the cutting wheel 260 is a substantial portion of the overall weight of the front of the machine 210.

The drive mechanisms of the alternate digging machine 210 are similar to the machine previously described. A motor 230 provides drive mechanism through a clutch 280 which connects a pulley 282 through an engine shaft 231 to a large pulley 292 via drive belt 286. The large pulley 292 in turn rotates a jack shaft 294 which is rotatably mounted on the main frame 220 by bearings **296*a* and 296*b*. A gear 298 on the opposite end of the jack shaft 294 rotates a drive chain 302 which in turn rotates a gear 300 to rotate the cutting wheel shaft 262. The cutting wheel shaft 262 is mounted on the main frame 220 by bearings 304*a* and 304*b*. The cutting wheel 260 is securely mounted to the end of the cutting wheel shaft 262, which similar to the previous embodiment, places the cutting wheel 260** in a vertical plane outside the wheel width or wheel axis.

Figure 10:
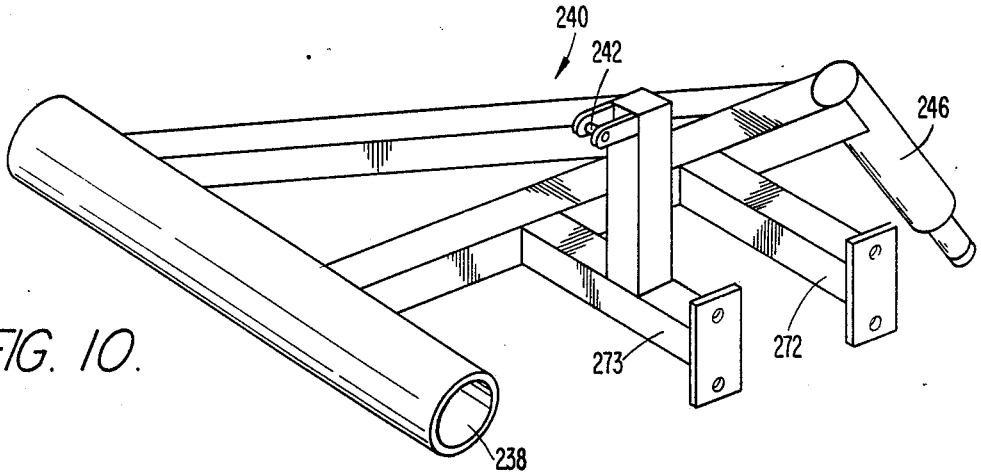
FIG. 10 is a perspective view of the main frame portion of the cutting machine of FIG. 5.
Figure 11:
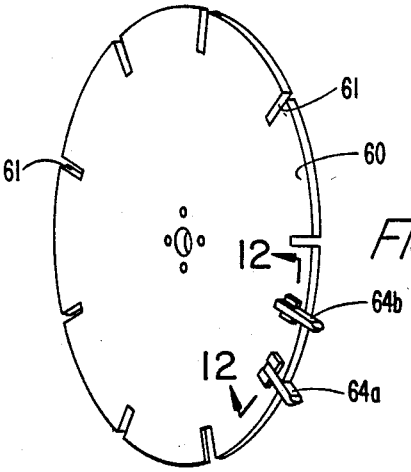
FIG. 11 is a perspective view of a cutting wheel suitable for the machines of the above embodiments.

The cutting wheel 260 has a plurality of cutting teeth 264 positioned on its outer periphery. Surrounding the cutting wheel is a two-piece clam shell type cover or guard **266*a* and 266*b* which cooperate to insure that the cutting wheel 260 is covered throughout the raised and lowered positions. The rearward cutting wheel cover 266*b*, having a hemispherical shape, is attached to the main frame 220 and the forward cover 266*a*, also having a hemispherical shape, is attached to the secondary frame portion 240 along extension bars 272 and 273 (as best shown in FIG. 10**).

The rear wheels 224 are driven off the engine shaft 231 by a drive belt 288 connecting a pulley 284 on the engine shaft 231 to a pulley 290. The pulley 290 provides driving force for the hydrostatic transmission 320 which in turn rotates the rear axle 222 thereby driving the wheels 224.

Other safety features are similar to that previously described. For example a chain guard **302*a* is located to encompass the drive chain 302**.

Details of the cutting wheel 60 which may be used with the present invention will now be described with respect to FIGS. 11, 12, 13 and 14. The cutting wheel 60 is basically a removable metal disc having a plurality of teeth **64*a* and 64*b*** spaced about its outer periphery.

Figure 12:
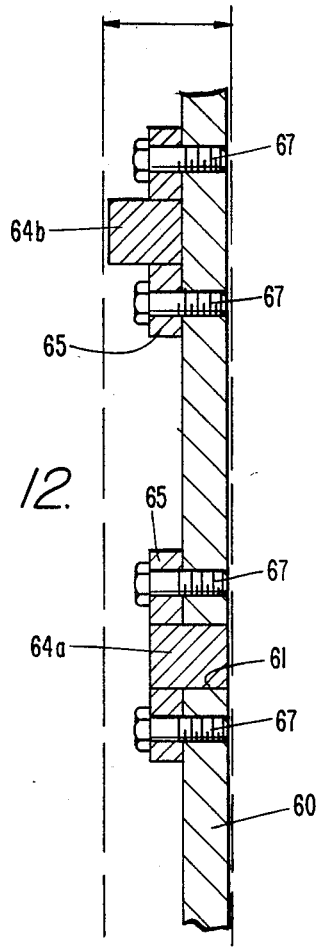
FIG. 12 is a cross-sectional view of FIG. 11 taken along the line 12—12 showing the cutting teeth.
Figure 13:
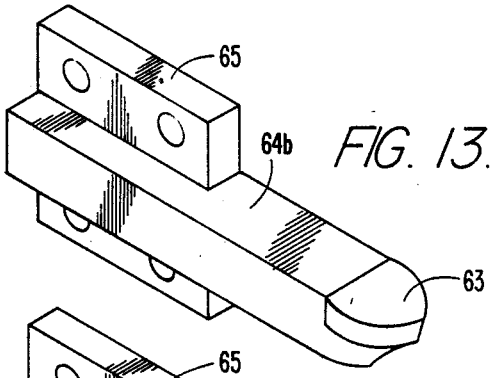
FIG. 13 is a perspective view of a first cutting tooth.
Figure 14:
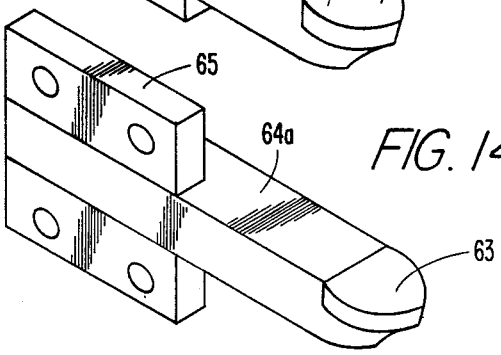
FIG. 14 is a perspective view of a second cutting tooth for use with a cutting wheel.

Each of the teeth 64a and 64b has a hardened tip 63 which undergoes most of the digging force. A cutting wheel 60 having teeth of this configuration can cut not only through hard packed dirt but also through roots of substantial diameter. The tooth, whether 64a or 64b, has a rectangular cross section and is attached to the cutting wheel 60 by a mounting bracket 65. The cutting wheel 60 has a plurality of radial grooves 61 spaced about its outer circumference. As shown in FIG. 12, the radial grooves 61 accommodate the insertion of a tooth 64a. The bracket 65 being bolted into the cutting wheel 60 by bolt 67 thereby securing the tooth 64a to the cutting wheel 60. In order to increase the width of the trench being dug, the tooth 64b may be placed adjacent the cutting wheel 60 with the bracket 65 being bolted to the wheel 60 by bolts 67. Therefore as viewed in FIG. 12, consecutive teeth 64a and 64b are offset in a direction perpendicular to the plane of the cutting wheel 60.

The design of the digging machine 10 of the present invention having the cutting wheel 60 outside the wheel width more readily accommodates a wider cutting wheel since dirt and debris is moved clear of the machine wheels.

Therefore a trench digging or root pruning machine has been shown and described. Though certain advantages and embodiments of the present invention have been described, many more modifications would be obvious from those skilled in the art from the descriptions herein. The invention therefore is not to be limited except in the spirit of the claims that follow.

What is claimed is:

1. An apparatus for ditch digging or root pruning comprising:

a frame having a main frame portion and a secondary frame portion;

a main wheel axis having at least two main wheels rotatably mounted on opposite sides of the main frame portion establishing a wheel width;

a secondary wheel axis having at least a secondary wheel supported on the secondary frame portion;

a motor mounted on the frame;

a cutting wheel rotatably mounted on the frame and operably connected to the rotor, the cutting wheel rotating in a substantially vertical plane located outside the wheel width, wherein the main frame portion and the secondary frame portion are pivotably connected about a horizontal pivot axis which is (a) perpendicular to the plane of the cutting wheel and (b) positioned between the main wheel axis and the secondary wheel axis; and means for pivoting the main frame portion relative to the secondary frame portion about the horizontal pivot axis, such that the pivoting of the frame portions raises or lowers both the cutting wheel and the horizontal pivot axis.

2. The apparatus according to claim 1 further comprising a hemispherical cutting wheel cover positioned over the cutting wheel and attached to the main frame portion.

3. The apparatus according to claim 1 wherein the means for pivoting the frame portion comprises an actuator mounted on the frame and extending between the main frame portion and the secondary frame portion, the actuator selectively expanding and retracting to pivot the main frame portion relative to the secondary frame portion.

4. The apparatus according to claim 1 further comprising an electric actuation motor for powering the actuator.

5. The apparatus according to claim 1 wherein the motor is operably connected to and rotates the cutting wheel.

6. The apparatus according to claim 1 further comprising a centrifugal clutch operably connected between the motor and the cutting wheel, the clutch transferring power to the cutting wheel only the motor speed is above a certain level.

7. The apparatus according to claim 1 further comprising a drive mechanism operably connecting the motor and at least one of the main wheels.

8. The apparatus according to claim 1 further comprising a plurality of cutting teeth attached to and spaced about an outer circumference of the cutting wheel and extending radially outward therefrom.

9. The apparatus according to claim 1 in which the secondary wheel is steerably attached to the secondary frame portion.

10. The apparatus according to claim 1 wherein the secondary wheel is steerably mounted about a king pin attached to the secondary frame.

11. The apparatus according to claim 10 wherein the steering axis of the king pin is substantially vertical when the cutting wheel is in a raised position.

12. An apparatus for ditch digging or root pruning comprising:

a frame having a main frame portion and a secondary frame portion;

at least two main wheels rotatably mounted on opposite sides of the main frame portion establishing a wheel width;

at least a secondary wheel supported on the secondary frame portion;

a motor mounted on the frame;

a cutting wheel rotatably mounted on the frame and operably connected to the motor, the cutting wheel rotating in a substantially vertical plane, wherein the main frame portion and the secondary frame portion are pivotally connected about a horizontal pivot axis which is perpendicular to the plane of the cutting wheel;

means for pivoting the main frame portion relative to the secondary frame portion about the horizontal pivot axis, such that the pivoting of the frame portions raises or lowers both the cutting wheel and the horizontal pivot axis;

a hemispherical cutting wheel cover positioned over the cutting wheel and attached to the main frame portion; and a cutting wheel guard attached to the secondary frame portion adjacent the cutting wheel and cooperating with the cutting wheel cover to substantially enclose any portion of the cutting wheel which is above ground.

13. An apparatus for digging or root pruning comprising:

a frame having a front frame portion and a rear frame portion;

a front axle supported by the front frame portion;

two front wheels rotatably mounted on opposite ends of the front axle establishing a wheel width;

a rear axle having a rear wheel steerably supported on the rear frame portion;

a motor mounted on the frame;

a cutting wheel rotatably mounted on the frame and operably connected to the motor, the cutting wheel rotating in a substantially vertical plane located outside the wheel width, wherein the front frame portion and the rear frame portion are pivotally connected about a horizontal pivot axis which is (a) perpendicular to the plane of the cutting wheel and (b) positioned between the front axle and the rear axle; and means for pivoting the front frame portion relative to the rear frame portion, such that the pivoting of the frame portions raises or lowers both the cutting wheel and the horizontal pivot axis.

14. The apparatus according to claim 13 further comprising a hemispherical cutting wheel guard positioned over the cutting wheel and attached to the front frame portion.

15. An apparatus for digging or root pruning comprising:

a frame having a front frame portion and a rear frame portion;

a front axle supported by the front frame portion;

two front wheels rotatably mounted on opposite ends of the front axle establishing a wheel width;

a rear wheel steerably supported on the rear frame portion;

a motor mounted on the frame;

a cutting wheel rotatably mounted on the frame and operably connected to the motor, the cutting wheel rotating in a substantially vertical plane, wherein the front frame portion and the rear frame portion are pivotally connected about a horizontal pivot axis which is perpendicular to the plane of the cutting wheel;

means for pivoting the front frame portion relative to the rear frame portion, such that the pivoting of the frame portions raises or lowers both the cutting wheel and the horizontal pivot axis;

a hemispherical cutting wheel guard positioned over the cutting wheel and attached to the front frame portion; and a vertical shield attached to the rear frame portion adjacent the cutting wheel and cooperating with the cutting wheel guard to substantially enclose any portion of the cutting wheel which is above ground.

16. An apparatus for ditch digging or root pruning comprising:

a frame having a main frame portion and a secondary frame portion;

at least two main wheels rotatably mounted on opposite sides of the main frame portion establishing a wheel width;

at least a secondary wheel supported on the secondary frame portion;

a motor mounted on the frame;

a cutting wheel rotatably mounted on the frame and operably connected to the motor, the cutting wheel rotating in a substantially vertical plane, wherein the main frame portion and the secondary frame portion are pivotally connected about a horizontal axis which is perpendicular to the plane of the cutting wheel; and means for pivoting the frame portions about the horizontal axis, wherein the pivoting of the frame portions raises and lowers the cutting wheel, wherein the secondary wheel is steerably mounted about a king pin attached to the secondary frame and wherein an angle of the steering axis of the king pin relative to the ground decreases as the cutting wheel is lowered to decrease the steerability of the secondary wheel while the cutting wheel is in a lowered position.

17. An apparatus for ditch digging or root pruning comprising:

a frame having a main frame portion and a secondary frame portion;

at least two main wheels rotatably mounted on opposite sides of the main frame portion establishing a wheel width;

at least a secondary wheel supported on the secondary frame portion;

a motor mounted on the frame;

a cutting wheel rotatably mounted on the frame and operably connected to the motor, the cutting wheel rotating in a substantially vertical plane, wherein the main frame portion and the secondary frame portion are pivotally connected about a horizontal axis which is perpendicular to the plane of the cutting wheel; and means for pivoting the frame portions about the horizontal axis, wherein the pivoting of the frame portions raises and lowers the cutting wheel, wherein components mounted on the main frame are situated such that weight distribution of the components is shifted between the main and secondary wheels during raising and lowering of the cutting wheel such that (1) weight is shifted onto the main wheels when the cutting wheel is in a raised position and (2) weight is shifted onto the secondary wheel when the cutting wheel is in a lowered position.

* * * * *